US009643425B2

(12) United States Patent
Munakata

(10) Patent No.: US 9,643,425 B2
(45) Date of Patent: May 9, 2017

(54) LIQUID DISCHARGE APPARATUS

(71) Applicant: SEIKO EPSON CORPORATION, Tokyo (JP)

(72) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/231,036

(22) Filed: Aug. 8, 2016

(65) Prior Publication Data

US 2017/0043587 A1 Feb. 16, 2017

(30) Foreign Application Priority Data

Aug. 11, 2015 (JP) ..... 2015-159132

(51) Int. Cl.

| | |
|---|---|
| ***B41J 29/393*** | (2006.01) |
| ***B41J 2/175*** | (2006.01) |
| ***B41J 2/045*** | (2006.01) |
| ***B41J 2/165*** | (2006.01) |

(52) U.S. Cl.

CPC ..... *B41J 2/17566* (2013.01); *B41J 2/0451* (2013.01); *B41J 2/0456* (2013.01); *B41J 2/0459* (2013.01); *B41J 2/04581* (2013.01); *B41J 2/04588* (2013.01); *B41J 2/165* (2013.01); *B41J 2/16579* (2013.01); *B41J 29/393* (2013.01); *B41J 2002/17569* (2013.01); *B41J 2002/17589* (2013.01)

(58) Field of Classification Search

CPC B41J 2/17566; B41J 2/16579; B41J 2/04581; B41J 29/393; B41J 2/0456; B41J 2/0451; B41J 2/165; B41J 2/0459; B41J 2/04588; B41J 2002/17589; B41J 2002/17569

See application file for complete search history.

(56) References Cited

U.S. PATENT DOCUMENTS

2005/0110815 A1* 5/2005 Merz ..... B41J 2/17566 347/7

2016/0107440 A1* 4/2016 Kanzawa ..... B41J 2/04581 347/10

FOREIGN PATENT DOCUMENTS

JP 2007-160671 6/2007

* cited by examiner

*Primary Examiner* — Julian Huffman

(74) *Attorney, Agent, or Firm* — Workman Nydegger

(57) ABSTRACT

A liquid discharge apparatus includes: a liquid discharge section configured to discharge liquid supplied from a liquid container in accordance with a drive signal; a sensor configured to measure a remaining quantity of the liquid in the liquid container; a measurement section configured to identify a measurement consumption quantity being a variation quantity of the remaining quantity in a measurement period; an estimation section configured to estimate an estimated consumption quantity of the liquid in accordance with print contents in the measurement period; a comparison section configured to make a comparison between the measurement consumption quantity and the estimated consumption quantity; if the measurement consumption quantity is smaller than the estimated consumption quantity by comparison of the comparison section, an inspection section configured to inspect whether or not there is a discharge defect in the liquid discharge section; and if the inspection section determines that there are no discharge defects, an adjustment section configured to adjust an amplitude of the drive signal.

7 Claims, 8 Drawing Sheets

LIQUID DISCHARGE APPARATUS

BACKGROUND

1. Technical Field

The present invention relates to a technique for discharging liquid, such as ink.

2. Related Art

To date, liquid discharge apparatuses that discharge liquid, such as ink, or the like from a nozzle by the supply of a drive signal have been proposed. For example, JP-A-2007-160671 discloses a printer in which the voltage of a drive signal is corrected in accordance with the difference between the amplitude of a detection signal indicating a change in the electric field when liquid is discharged to a droplet receiving section (cap) and a predetermined reference amplitude.

In the technique in JP-A-2007-160671, it is necessary to have a change in the electric field when liquid is actually discharged to a droplet receiving section in order to generate a detection signal or correct a drive signal. However, in reality, for example, a discharge defect in which liquid is not discharged from a nozzle may occur. In a situation in which such a discharge defect has occurred, there is a problem with the technique in JP-A-2007-160671 in that it is not possible to suitably correct the voltage of the drive signal.

SUMMARY

An advantage of some aspects of the invention is that the discharge characteristic of liquid is suitably adjusted. According to an aspect of the invention, there is provided a liquid discharge apparatus including a liquid discharge section configured to discharge liquid supplied from a liquid container in accordance with a drive signal; a sensor configured to measure a remaining quantity of the liquid in the liquid container; a measurement section configured to identify a measurement consumption quantity being a variation quantity of the remaining quantity in a measurement period; an estimation section configured to estimate an estimated consumption quantity of the liquid in accordance with print contents in the measurement period; a comparison section configured to make a comparison between the measurement consumption quantity and the estimated consumption quantity; if the measurement consumption quantity is smaller than the estimated consumption quantity by comparison of the comparison section, an inspection section configured to inspect whether or not there is a discharge defect in the liquid discharge section; and if the inspection section determines that there are no discharge defects, an adjustment section configured to adjust an amplitude of the drive signal. In the above aspect, when the measurement consumption quantity is smaller than the estimated consumption quantity, whether or not there is a discharge defect in the liquid discharge section is inspected, and if there are no discharge defects, the amplitude of the drive signal is adjusted. Accordingly, compared with a configuration in which the amplitude of the drive signal is adjusted regardless of the existence of a discharge defect, it is possible to suitably adjust the amplitude of the drive signal so as to reduce errors in the discharge characteristic (for example, the discharge rate and the discharge speed) of the liquid discharge section.

The liquid discharge apparatus according to a preferred aspect of the invention may further include a control section configured to cause the liquid discharge section to perform a recovery operation if the inspection section determines that there is a discharge defect. In the above aspect, if the inspection section determines that there is a discharge defect, a recovery operation is performed and thus it is possible to decrease the influence of the discharge defect of the liquid discharge section so as to effectively reduce errors of the discharge characteristic. In this regard, a recovery operation is a generic term of an operation for making the discharge characteristic by the liquid discharge section close to the target characteristic (that is to say, to recover to the design characteristic). For example, a cleaning operation, such as a suction process, in which liquid is sucked from the upstream side in the sealed state of the discharge opening (nozzle) of the liquid, or a flushing process for discharging thickened liquid in the vicinity of the discharge opening is a preferred example of the recovery operation.

In the liquid discharge apparatus according to a preferred aspect, the comparison section may make the comparison after the liquid discharge section discharges the liquid after the recovery operation is performed. In the above aspect, after the recovery operation is performed, the liquid discharge section discharges the liquid and then a comparison is made between the measurement consumption quantity and the estimated consumption quantity. Accordingly, a comparison is made between the measurement consumption quantity, which is produced by reflecting the actual discharge tendency of the liquid discharge section after performing the recovery operation, and the estimated consumption quantity. Thus it is advantageously possible to adjust the amplitude of the drive signal in accordance with the comparison result.

In the liquid discharge apparatus according to a preferred aspect, if the measurement consumption quantity is within a permissible range including the estimated consumption quantity, adjustment by the adjustment section and inspection by the inspection section may not be performed. In the above aspect, if the measurement consumption quantity is within a permissible range including the estimated consumption quantity, adjustment by the adjustment section and inspection by the inspection section are not performed, and thus it is possible to stably control the amplitude of the drive signal compared with the configuration of not setting a permissible range.

In the liquid discharge apparatus according to a preferred aspect, if the measurement consumption quantity is larger than an upper limit value of the permissible range, the adjustment section may decrease the amplitude of the drive signal. In the above aspect, if the measurement consumption quantity is larger than an upper limit value of the permissible range (for example, in the case where the liquid having a lower viscosity compared with the design value is stored in the liquid container), the amplitude of the drive signal is decreased. Accordingly, it is possible to make the discharge characteristic of the liquid discharge section close to the target characteristic by suppressing the discharge rate.

In the liquid discharge apparatus according to a preferred aspect, if the measurement consumption quantity is smaller than a lower limit value of the permissible range, the adjustment section may increase the amplitude of the drive signal. In the above aspect, if the measurement consumption quantity is smaller than a lower limit value of the permissible range (for example, in the case where the liquid has a higher viscosity compared with the design value), it is possible to make the discharge characteristic of the liquid discharge section close to the target characteristic by increasing the discharge rate.

In the liquid discharge apparatus according to a preferred aspect, the liquid container may have a configuration to allow addition of the liquid, and the liquid discharge apparatus may further include a range control section configured to determine whether or not the liquid is added to the liquid container in accordance with a variation in the remaining quantity of the liquid measured by the sensor, and if determined that the liquid is added, to reduce the permissible range and then to expand the permissible range with time. In the above aspect, if the liquid is added to the liquid container, the permissible range is reduced so that it becomes easy to perform adjustment of the amplitude of the drive signal. Accordingly, it is possible to promptly adjust the drive signal to have a suitable amplitude capable of discharging the liquid at the target discharge characteristic regardless of the value of the viscosity of the liquid added to the liquid container.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
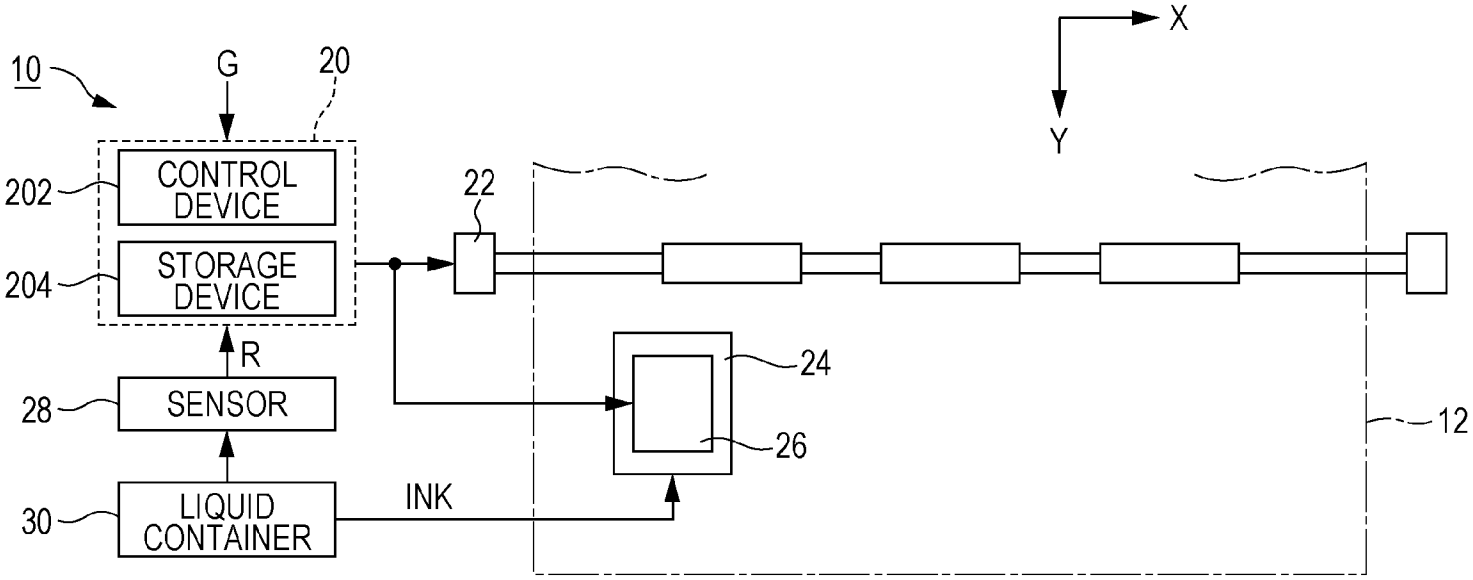
FIG. 1 is a configuration diagram of a liquid discharge apparatus according to a first embodiment.

FIG. 1 is a partial configuration diagram of a liquid discharge apparatus 10 according to a first embodiment of the invention. The liquid discharge apparatus 10 according to the first embodiment is an ink jet printer that discharges ink, which is an example of liquid, onto a medium 12, such as printing paper, or the like. As illustrated in FIG. 1, the liquid discharge apparatus 10 includes a control unit 20, a transport mechanism 22, a carriage 24, a liquid discharge unit 26, a sensor 28, and a liquid container 30. The liquid container 30 is a container (ink tank) that stores ink. In reality, a plurality of colors of ink is stored in the liquid container 30. However, in the following description, attention is focused on one kind of ink for the sake of convenience. The liquid discharge apparatus 10 according to the first embodiment is a continuous ink supply system (CISS) printer capable of replenishing the liquid container 30 with ink later. However, it is also possible to use a removable cartridge for the liquid discharge apparatus 10 as the liquid container 30.

The control unit 20 includes, for example, a control device 202, such as a central processing unit (CPU), a field programmable gate array (FPGA), or the like, and a storage device 204, such as a semiconductor memory, or the like. The control device 202 executes a control program stored in the storage device 204 so as to totally control each component of the liquid discharge apparatus 10. Print data G representing an image to be formed on the medium 12 is supplied from an external device (not illustrated in FIG. 1), such as a host computer, or the like to the control unit 20. The control unit 20 controls each component of the liquid discharge apparatus 10 so that the image specified by the print data G is formed on the medium 12.

The transport mechanism 22 includes, for example, a transport motor for transporting the medium 12 and a drive circuit for driving the transport motor (not illustrated in FIG. 1), and transports the medium 12 in the Y-direction under the control of the control unit 20. The liquid discharge unit 26 is mounted on a substantially box-shaped carriage 24, and discharges ink supplied from the liquid container 30 onto the medium 12 under the control of the control unit 20. The control unit 20 reciprocates the carriage 24 along the X-direction that intersects with the Y-direction. The liquid discharge unit 26 discharges ink onto the medium 12 in parallel with the transportation of medium 12 by the transport mechanism 22 and the repetitive reciprocation of the carriage 24 so that a desired image is formed on the surface of the medium 12. In this regard, it is also possible to mount the liquid container 30 on the carriage 24 with the liquid discharge unit 26.

Figure 2:
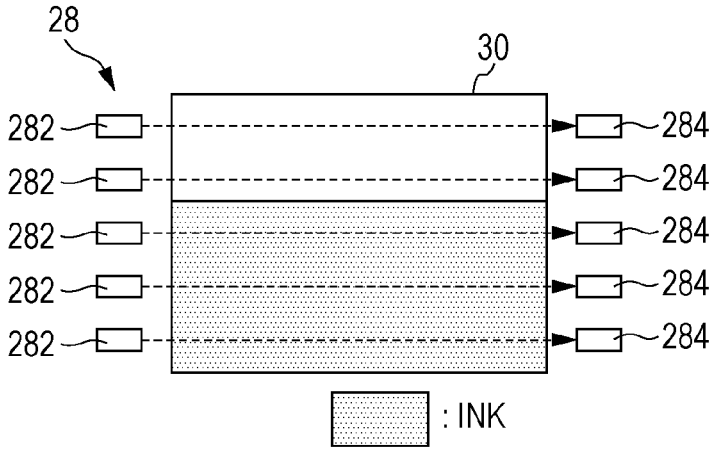
FIG. 2 is an explanatory diagram of a sensor that measures the remaining quantity of ink in a liquid container.
Figure 3:
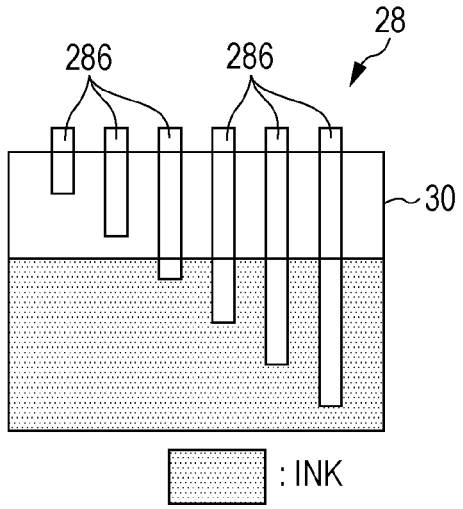
FIG. 3 is an explanatory diagram of another example of the sensor.

The sensor 28 is a measuring instrument for measuring the quantity (hereinafter referred to as a "remaining quantity") R of the ink stored in the liquid container 30. For example, as illustrated in FIG. 2, an optical detector in which a plurality of pairs of a light emitting element 282, such as a light emitting diode, or the like and a light receiving element 284 that receives the light emitted from the light emitting element 282 are disposed at different positions in the vertical direction is suitable for the sensor 28. In the configuration in FIG. 2, the position of the liquid surface of the ink in the liquid container 30 is measured as the remaining quantity R in accordance with the amount of light received by each of the light receiving elements 284 through the liquid container 30. Also, as illustrated in FIG. 3, it is also possible to use an electrical measuring instrument in which a plurality of detection electrodes 286 having different lower end positions in the vertical direction are disposed inside the liquid container 30 and which measures the position of the liquid surface of the ink as the remaining quantity R in accordance with the potential difference among the detection electrodes 286 as the sensor 28. It is also possible to use a weighting scale that measures the weight of the liquid container 30 as the remaining quantity R for the sensor 28.

Figure 4:
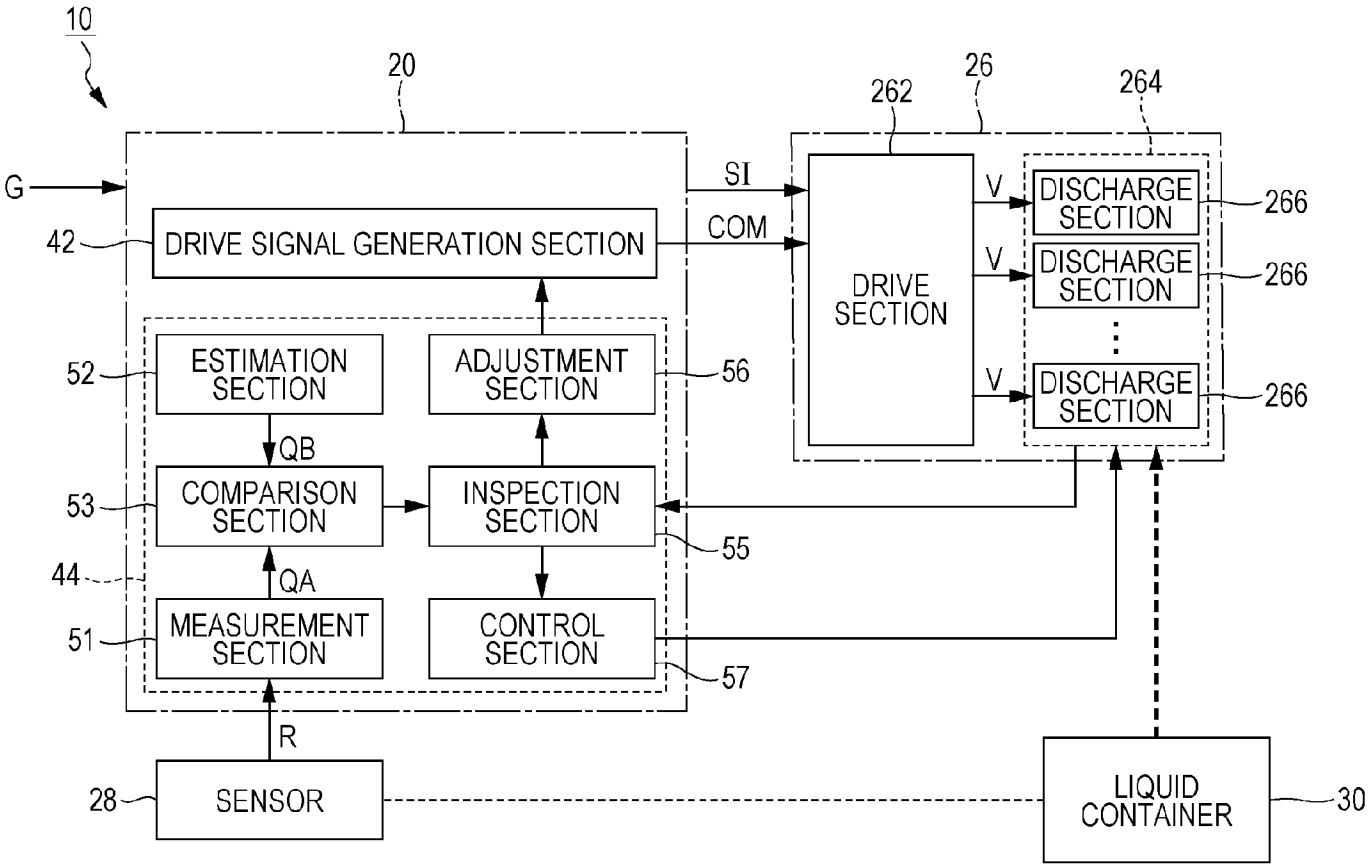
FIG. 4 is a functional configuration diagram of the liquid discharge apparatus.
Figure 5:
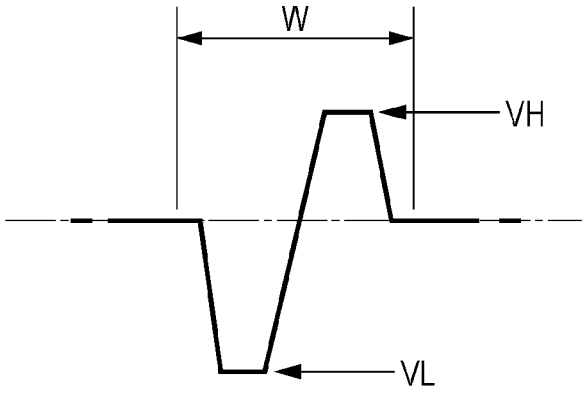
FIG. 5 is a waveform chart of a drive waveform signal.

FIG. 4 is a functional configuration diagram of the liquid discharge apparatus 10. The transport mechanism 22, the carriage 24, and the like are not illustrated in FIG. 4 for the sake of convenience. As illustrated in FIG. 4, in the control unit 20 in the first embodiment, the control device 202 executes a control program so as to function as a drive signal generation section 42 and a management section 44. The drive signal generation section 42 generates a drive waveform signal COM. As illustrated in FIG. 5, the drive waveform signal COM is a voltage signal including a drive pulse W at each predetermined period. The drive signal generation section 42 according to the first embodiment adjusts one of or both of the high-potential side voltage VH and the low-potential side voltage VL of the drive waveform signal COM so as to variably control the amplitude A (the difference value between the high-potential side voltage VH and the low-potential side voltage VL). In this regard, a specific waveform of the drive pulse W is an any waveform. Also, it is possible to employ a configuration including a plurality of drive pulses W in one period of the drive waveform signal COM or a configuration of using a plurality of drive waveform signals COM having different waveforms.

As illustrated in FIG. 4, the liquid discharge unit 26 in the first embodiment includes a drive section 262 and a liquid discharge section 264. The drive section 262 drives the liquid discharge section 264 under the control of the control unit 20. The liquid discharge section 264 discharges the ink supplied from the liquid container 30 from a plurality of nozzles to the medium 12. The liquid discharge section 264 in the first embodiment includes a plurality of the discharge sections 266 corresponding to the respective different nozzles. Each discharge section 266 discharges ink in accordance with a drive signal V supplied from the drive section 262.

As illustrated in FIG. 4, the drive waveform signal COM generated by the drive signal generation section 42 and a print signal SI that indicates the presence or absence of ink in accordance with print data G are supplied from the control unit 20 to the drive section 262. The drive section 262 generates the drive signal V in accordance with the drive waveform signal COM and the print signal SI for each discharge section 266, and outputs the respective drive signals V to the plurality of discharge sections 266 in parallel. Specifically, the drive section 262 supplies the drive pulse W of the drive waveform signal COM to the discharge section 266 to which the print signal SI instructs to discharge ink as the drive signal V out of the plurality of discharge sections 266, and supplies the drive signal V of a predetermined reference voltage to the discharge section 266 to which the print signal SI instructs not to discharge ink. In this regard, in the configuration using a plurality of drive waveform signals COM or the configuration in which the drive waveform signal COM includes a plurality of drive pulses W, it is possible to control the discharge rate of ink by the discharge section 266 by outputting a combination of the drive pulses W specified by the print signal SI to the discharge section 266 as the drive signal V.

Figure 6:
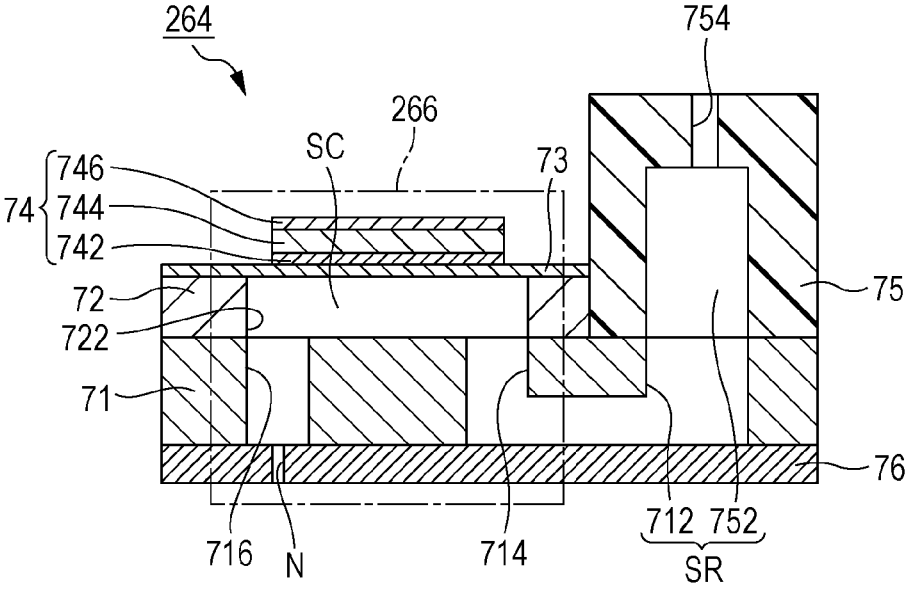
FIG. 6 is a sectional view of a liquid discharge section.

FIG. 6 is a sectional view of the liquid discharge section 264 when attention is focused on any one of the discharge sections 266. As illustrated in FIG. 6, the liquid discharge section 264 has a structure in which a pressure chamber substrate 72, a diaphragm 73, a piezoelectric element 74, a support 75 are disposed on one side of a flow path substrate 71, and a nozzle plate 76 is disposed on the other side. The flow path substrate 71, the pressure chamber substrate 72, and the nozzle plate 76 are formed by respective silicon flat plates, for example, and the support 75 is formed by a resin material using injection molding, for example. A plurality of nozzles N are formed on the nozzle plate 76. In this regard, it is possible to arrange the plurality of nozzles N in a plurality of columns (for example, in a zigzag arrangement or in a staggered arrangement).

An opening section 712, a branched channel (throttle channel) 714, and a communicating channel 716 are formed in the flow path substrate 71. The branched channel 714 and the communicating channel 716 are through holes that are formed for each nozzle N, and the opening section 712 is a continuing opening that communicates the plurality of nozzles N. The space that mutually communicates an accommodating section (concave portion) 752 formed in the support 75 and the opening section 712 in the flow path substrate 71 function as a common liquid chamber (reservoir) SR that stores ink supplied from the liquid container 30 through an introduction channel 754 of the support 75.

An opening section 722 is formed in the pressure chamber substrate 72 for each nozzle N. The diaphragm 73 is an elastically deformable flat plate disposed on the surface of the opposite side to the flow path substrate 71 of the pressure chamber substrate 72. The space sandwiched between the diaphragm 73 and the flow path substrate 71 in each opening section 722 of the pressure chamber substrate 72 functions as a pressure chamber (cavity) SC in which ink supplied from the common liquid chamber SR is filled through the branched channel 714. Each pressure chamber SC communicates with the nozzle N through the communicating channel 716 of the flow path substrate 71.

The piezoelectric element 74 is formed on the surface of the opposite side of the diaphragm 73 to the pressure chamber substrate 72 for each nozzle N. Each piezoelectric element 74 is a drive element produced interposing a piezoelectric body 744 between the first electrode 742 and a second electrode 746. The drive signal V is supplied to one of the first electrode 742 and the second electrode 746, and a predetermined reference voltage is supplied to the other of the electrodes. When the piezoelectric element 74 is deformed by supplying the drive signal V (the drive pulse W) so that the diaphragm 73 is vibrated, the pressure in the pressure chamber SC varies, and thus the ink in the pressure chamber SC is discharged from the nozzle N. Specifically, the ink having the discharge rate in accordance with the amplitude A of the drive signal V is discharged from the nozzle N. That is to say, the discharge rate of the ink discharged by the discharge section 266 increases as the amplitude A of the drive signal V becomes larger. One of the discharge sections 266 illustrated in FIG. 4 is a portion that includes the piezoelectric element 74, the diaphragm 73, the pressure chamber SC, and the nozzle N. In this regard, it is possible to use either the first electrode 742 or the second electrode 746, to which the reference voltage is supplied, as a common electrode over a plurality of piezoelectric elements 74.

The management section 44 illustrated in FIG. 4 controls the operation of the liquid discharge section 264 in accordance with the discharge state of ink by the liquid discharge section 264. As illustrated in FIG. 4, the management section 44 in the first embodiment includes a measurement section 51, an estimation section 52, a comparison section 53, an inspection section 55, an adjustment section 56, and a control section 57. In this regard, it is also possible to employ a configuration in which each component of the management section 44 is shared by a plurality of devices, or a configuration in which a partial element of the management section 44 is actualized by a dedicated electronic circuit.

The measurement section 51 obtains the remaining quantity R of ink in the liquid container 30 from the sensor 28, and identifies a variation quantity (hereinafter referred to as a "measurement consumption quantity") QA of the remaining quantity R in a specific period (hereinafter referred to as a "measurement period"). Specifically, the measurement section 51 calculates the difference between the remaining quantity R at the start point of the measurement period and the remaining quantity R at the end point of the measurement period as the measurement consumption quantity QA. The measurement period is set to a time length during which the remaining quantity R of ink in the liquid container 30 is predicted to change by a significant quantity.

The estimation section 52 estimates a consumption quantity (hereinafter referred to as an "estimated consumption quantity") QB of ink in accordance with the print contents in the measurement period. Specifically, the estimation section 52 sums up the discharge rate of ink determined for each discharge section 266 in accordance with the print data G supplied from the external device in the measurement period so as to calculate the estimated consumption quantity QB. In this regard, it is also possible to sum up the discharge rate instructed by the print signal SI to the discharge section 266 for all the discharge sections 266 in the measurement period so that the estimation section 52 calculates the estimated consumption quantity QB. As is understood from the above description, the measurement consumption quantity QA represents the actual consumption quantity by the liquid discharge section 264, and the estimated consumption quantity QB represents the consumption quantity of ink estimated by the print contents.

In an ideal state in which ink of the discharge rate in accordance with the print contents is correctly discharged from each discharge section 266, the measurement consumption quantity QA matches the estimated consumption quantity QB with each other. However, in the actual use environment, the viscosity of ink in the flow path (hereinafter referred to as a "supply flow path") from the liquid container 30 to the nozzle N via the common liquid chamber SR and the pressure chamber SC may vary in accordance with temperature and humidity. As described above, in a situation in which the viscosity of ink in the supply flow path varies from the reference value (for example, an ideal design value), there is a possibility that the measurement consumption quantity QA differs from the estimated consumption quantity QB.

In the CISS liquid discharge apparatus 10, a large amount of ink stored in the liquid container 30 particularly stays in the supply flow path for a long time period. It is therefore easy for the viscosity of ink in the supply flow path to change compared with the configuration of using a cartridge-type liquid container 30. Accordingly, the liquid discharge apparatus 10 has a tendency to reveal the difference between the measurement consumption quantity QA and the estimated consumption quantity QB. Also, in the CISS liquid discharge apparatus 10, for example, the liquid container 30 is replenished with non-regular ink having an unguaranteed viscosity, and thus the viscosity of the ink in the supply flow path may change. Accordingly, the liquid discharge apparatus 10 has a tendency to reveal the difference between the measurement consumption quantity QA and the estimated consumption quantity QB.

Specifically, in a situation (at the time of increasing viscosity) in which the viscosity of ink in the supply flow path is higher than the reference value, the actual discharge rate by the discharge section 266 decreases compared with the design value, and thus the measurement consumption quantity QA becomes smaller than the estimated consumption quantity QB (QA<QB). On the other hand, in a situation (for example, a situation in which the liquid container 30 is replenished with ink having a non-regular low viscosity) in which the viscosity of ink in the supply flow path is lower than the reference value, the actual discharge rate by the discharge section 266 increases compared with the design value, the measurement consumption quantity QA becomes larger than the estimated consumption quantity QB (QA>QB). In consideration of the above situation, the management section 44 (the comparison section 53, the adjustment section 56, and the control section 57) according to the first embodiment operates so as to correct the difference between the measurement consumption quantity QA and the estimated consumption quantity QB.

The comparison section 53 in FIG. 4 compares the measurement consumption quantity QA measured by the measurement section 51 and the estimated consumption quantity QB estimated by the estimation section 52. The adjustment section 56 adjusts the amplitude A of the drive signal V supplied by the liquid discharge section 264 in accordance with the comparison result by the comparison section 53. Specifically, the adjustment section 56 in the first embodiment instructs an adjustment of the amplitude A of the drive waveform signal COM to the drive signal generation section 42. The drive signal generation section 42 changes one of or both of the high-potential side voltage VH and the low-potential side voltage VL of the drive waveform signal COM in accordance with the instruction from the adjustment section 56 so as to adjust the amplitude A.

Roughly, if the measurement consumption quantity QA is smaller than the estimated consumption quantity QB (QA<QB), for example, it is estimated that ink is difficult to be discharged by the influence of an increase in the viscosity of ink in the supply flow path, or the like. Accordingly, the adjustment section 56 controls the drive signal generation section 42 so as to increase the amplitude A of the drive signal V. On the other hand, if the measurement consumption quantity QA is larger than the estimated consumption quantity QB (QA>QB), for example, it is estimated that ink is excessively discharged by the influence of replenishment of low viscosity ink. Accordingly, the adjustment section 56 controls the drive signal generation section 42 so as to decrease the amplitude A of the drive signal V.

Incidentally, for a situation in which the measurement consumption quantity QA is smaller than the estimated consumption quantity QB, it is assumed that a discharge failure has occurred in the liquid discharge section 264 in addition to the situation in which ink is difficult to be discharged by the influence of an increase in the viscosity of ink in the supply flow path in the example as described above. A discharge defect (a so-called dot omission) represents a state in which the discharge rate of ink from a part of the discharge sections 266 in the liquid discharge section 264 has decreased excessively or a state in which the discharge section 266 fails to discharge ink. For example, a typical example of a discharge defect is a state in which the nozzle N of the discharge section 266 or the flow path (for example, the communicating flow path 716 or the branched channel 714) is clogged by an increase in viscosity of ink or solidified ink in the supply flow path, or a foreign matter in the supply flow path so that ink discharge is inhibited.

In a situation caused by a discharge defect, in which the measurement consumption quantity QA is smaller than the estimated consumption quantity QB, if the amplitude A of the drive signal V is increased, excessive ink is discharged from the discharge section 266 having no discharge defects as a result. Accordingly, the adjustment of the amplitude A of the drive signal V is not suitable, and thus it is necessary to perform a recovery operation in order to resolve the discharge defect and to bring back the discharge section 266 to a normal state. Specifically, a typical example of the recovery operation includes a flushing process that preliminarily discharges ink from the discharge section 266, a cleaning process such as a suction process that sucks ink in the discharge section 266 by a tube pump (not illustrated in FIG. 4), or the like.

In consideration of the above situation, if the measurement consumption quantity QA is smaller than the estimated consumption quantity QB, the inspection section 55 in FIG. 4 inspects whether or not the liquid discharge section 264 has a discharge defect. It is possible to freely employ a publicly known technique for inspecting a discharge defect. For example, it is possible to analyze residual vibration (vibration of the piezoelectric element 74 or vibration of ink in the pressure chamber SC) that occurs in the discharge section 266 after driving the piezoelectric element 74 by supplying the drive pulse W (or the other pulse signal) so as to inspect the existence of a discharge defect for each discharge section 266. In this regard, JP-A-2013-000958 discloses the inspection of a discharge defect using residual vibration, for example.

If the inspection section 55 has determined that a discharge defect has not occurred in the liquid discharge section 264 (if a discharge defect has not been detected), the above-described adjustment section 56 adjusts the amplitude A of the drive signal V. On the other hand, if the inspection section 55 has determined that a discharge defect has occurred (if a discharge defect has been detected), the control section 57 causes the liquid discharge section 264 to perform the above-described recovery operation (flushing process or cleaning process, such as a suction process, or the like) in order to resolve the discharge defect.

Figure 7:
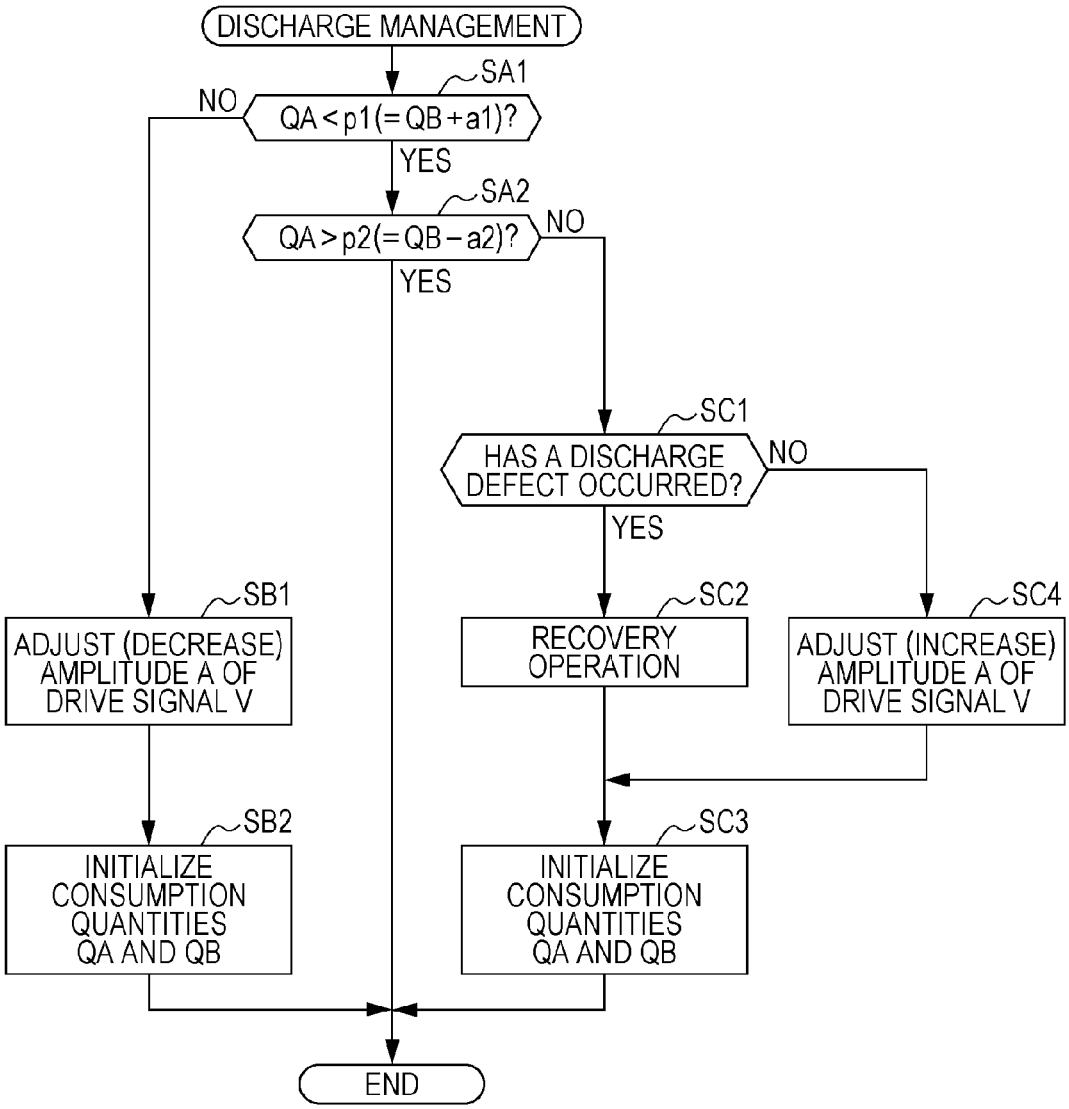
FIG. 7 is a flowchart of discharge management executed by a management section.

FIG. 7 is a flowchart of processing (hereinafter referred to as "discharge management") executed by the management section 44. For example, when a user instructs to perform a print operation or immediately after the power is turned on to the liquid discharge apparatus 10, the discharge management in FIG. 7 is started.

Figure 8:
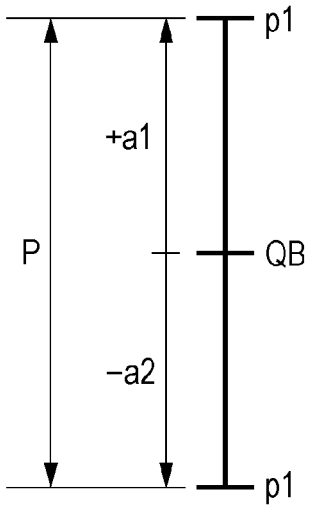
FIG. 8 is an explanatory diagram of a permissible range.

Step SA1 and step SA2 in FIG. 7 are processing for determining whether or not the measurement consumption quantity QA measured by the measurement section 51 is within a permissible range P. A permissible range P represents a range in which an error of the measurement consumption quantity QA with respect to the estimated consumption quantity QB should be permitted. As illustrated in FIG. 8, the permissible range P is set to a range including the estimated consumption quantity QB estimated by the estimation section 52. Specifically, the upper limit value p1 of the permissible range P is set to a numeric value ($p1=QB+a1$) of the sum of the estimated consumption quantity QB and an error coefficient a1, and the lower limit value p2 of the permissible range P is set to a numeric value ($p2=QB-a2$) of the difference when the an error coefficient a2 is subtracted from the estimated consumption quantity QB. The error coefficient a1 and the error coefficient a2 are set to a predetermined equal value a ($\alpha>0$). That is to say, it is possible to express step SA1 and step SA2 in FIG. 7 as a determination as to whether the absolute value of the difference value between the measurement consumption quantity QA and the estimated consumption quantity QB is larger than a predetermined value $\alpha$. In this regard, it is possible to set the error coefficient a1 and the error coefficient a2 to respective numeric values that are different with each other.

When the discharge management is started, the comparison section 53 determines whether or not the measurement consumption quantity QA is smaller than the upper limit value p1 of the permissible range P (SA1). If the measurement consumption quantity QA is larger than the upper limit value p1 (SA1: NO), for example, it is estimated that the liquid discharge section 264 is discharging excessive ink by the influence of replenishing the liquid container 30 with low viscosity ink. Accordingly, the adjustment section 56 decreases the amplitude A of the drive signal V under the control of the drive signal generation section 42 (SB1). When the adjustment section 56 adjusts the amplitude A, the measurement section 51 executes the initialization (QA=0) of the measurement consumption quantity QA, the estimation section 52 executes the initialization (QB=0) of the estimated consumption quantity QB (SB2), and the discharge management is terminated. As a result of a decrease (SB1) in the amplitude A of the drive signal V described above, the discharge rate of ink discharged from each discharge section 266 by the print operation decreases thereafter. Accordingly, the measurement consumption quantity QA is decreased to a numeric value within the permissible range P. That is to say, it is possible to make the discharge rate closer to the target discharge characteristic by the suppression of the discharge rate by the liquid discharge section 264.

If the measurement consumption quantity QA is smaller than the upper limit value p1 of the permissible range P (SA1: YES), the comparison section 53 determines whether or not the measurement consumption quantity QA is larger than the lower limit value p2 of the permissible range P (SA2). If the measurement consumption quantity QA is larger than the lower limit value p2 (SA2: YES), the discharge management in FIG. 7 is terminated. That is to say, if the measurement consumption quantity QA is within the permissible range P ($p2 \leq QA \leq p1$), the adjustment section 56 does not adjust the amplitude A of the drive signal V, and the inspection section 55 does not inspect the discharge defect.

On the other hand, if the measurement consumption quantity QA is smaller than the lower limit value p2 of the permissible range P (SA2: NO), the inspection section 55 inspects the liquid discharge section 264, and determines whether or not a discharge defect has occurred in the liquid discharge section 264 (SC1). If the inspection section 55 determines that a discharge defect has occurred (SC1: YES), it is estimated that that a shortage of the measurement consumption quantity QA is caused by a discharge defect. Thus, the control section 57 causes the liquid discharge section 264 to perform the recovery operation in order to resolve the discharge defect (SC2). When the recovery operation is completed, the measurement section 51 performs the initialization (QA=0) of the measurement consumption quantity QA, the estimation section 52 performs the initialization (QB=0) of the estimated consumption quantity QB (SC3), and then the discharge management is terminated. When the discharge defect is resolved or reduced by the recovery operation described above, the discharge rate of ink discharged from each discharge section 266, which is performed thereafter by the print operation, is increased. Accordingly, the measurement consumption quantity QA increases to a numeric value in the permissible range P.

On the other hand, if the inspection section 55 determines that no discharge defects have occurred (SC1: NO), it is estimated that an incident other than a discharge defect (for example, an increase in the viscosity of ink in the supply flow path) has caused the shortage of the measurement consumption quantity QA. That is to say, it is estimated that the discharge rate is insufficient for a large number of (for example, all of) discharge sections 266 of the liquid discharge section 264 in the same manner. Thus, the adjustment section 56 controls the drive signal generation section 42 in order to increase the amplitude A of the drive signal V (SC4). When the adjustment section 56 adjusts the amplitude A, the measurement section 51 performs the initialization (QA=0) of the measurement consumption quantity QA, the estimation section 52 performs the initialization (QB=0) of the estimated consumption quantity QB (SC3), and then the discharge management is terminated. As a result of an increase in the amplitude A of the drive signal V described above (SC4), the discharge rate of ink discharged from each discharge section 266, which is performed by the print operation, increases thereafter. Accordingly, the measurement consumption quantity QA increases to a numeric value within the permissible range P. That is to say, it is possible to make the discharge rate close to the target discharge characteristic by an increase in the discharge rate of the liquid discharge section 264.

As is understood from the above description, the adjustment (SB1 and SC4) of the amplitude A of the drive signal V by the adjustment section 56 and the recovery operation (SC2) performed by the liquid discharge section 264, which is caused by the control section 57, have the effect of making the measurement consumption quantity QA close to the estimated consumption quantity QB (that is to say, falls within the permissible range P).

When the discharge management of any one time is completed, a normal print operation by the liquid discharge section 264 is performed before the discharge management of the next time is started. Also, in addition to the normal print operation, it is possible to perform a test print operation for printing a predetermined print pattern. That is to say, after performing discharge management including the adjustment (SB1 and SC4) of the amplitude A of the drive signal V and the recovery operation (SC2) of the liquid discharge section 264, the liquid discharge section 264 discharges ink, and then the discharge management including the comparison by the comparison section 53 is performed. Accordingly, after the discharge management of the previous time (for example, the adjustment of the amplitude A and the recovery operation) is performed, a comparison is made between the measurement consumption quantity QA on which the actual tendency of the liquid discharge section 264 has been reflected and the estimated consumption quantity QB, and thus there is an advantage in that the amplitude A of the drive signal V is suitably adjusted in accordance with the comparison result.

In the first embodiment, when the measurement consumption quantity QA is smaller than the estimated consumption quantity QB (SA1: YES, SA2: NO), whether or not a discharge defect has occurred in the liquid discharge section 264 is inspected, and if no discharge defects have been detected (SC1: NO), the amplitude A of the drive signal V is adjusted. Accordingly, compared with the configuration in which the amplitude A of the drive signal V is adjusted regardless of the existence of a discharge defect, it is possible to suitably adjust the amplitude A of the drive signal V so as to reduce an error in the discharge characteristic of the liquid discharge section 264. In the first embodiment, in particular, if a discharge defect is detected (SC1: YES), the recovery operation is performed, and thus it is possible to suppress the influence of the discharge defect of the liquid discharge section 264 so as to effectively decrease an error of the discharge characteristic.

In the first embodiment, if the measurement consumption quantity QA is within the permissible range P (SA1: YES and SA2: YES), the adjustment section 56 does not perform the adjustment (SB1 and SC4). Accordingly, compared with the configuration (a1=a2=0) in which the permissible range P is not set, it is possible to stably control the amplitude A of the drive signal V (that is to say, suppress frequent variations).

Second Embodiment

In the following, a description will be given of a second embodiment of the invention. In this regard, in the following each mode, a symbol used in the description of the first embodiment is given to an element having the same actions and functions as those of the first embodiment, and a detailed description of each element will be suitably omitted.

Figure 9:
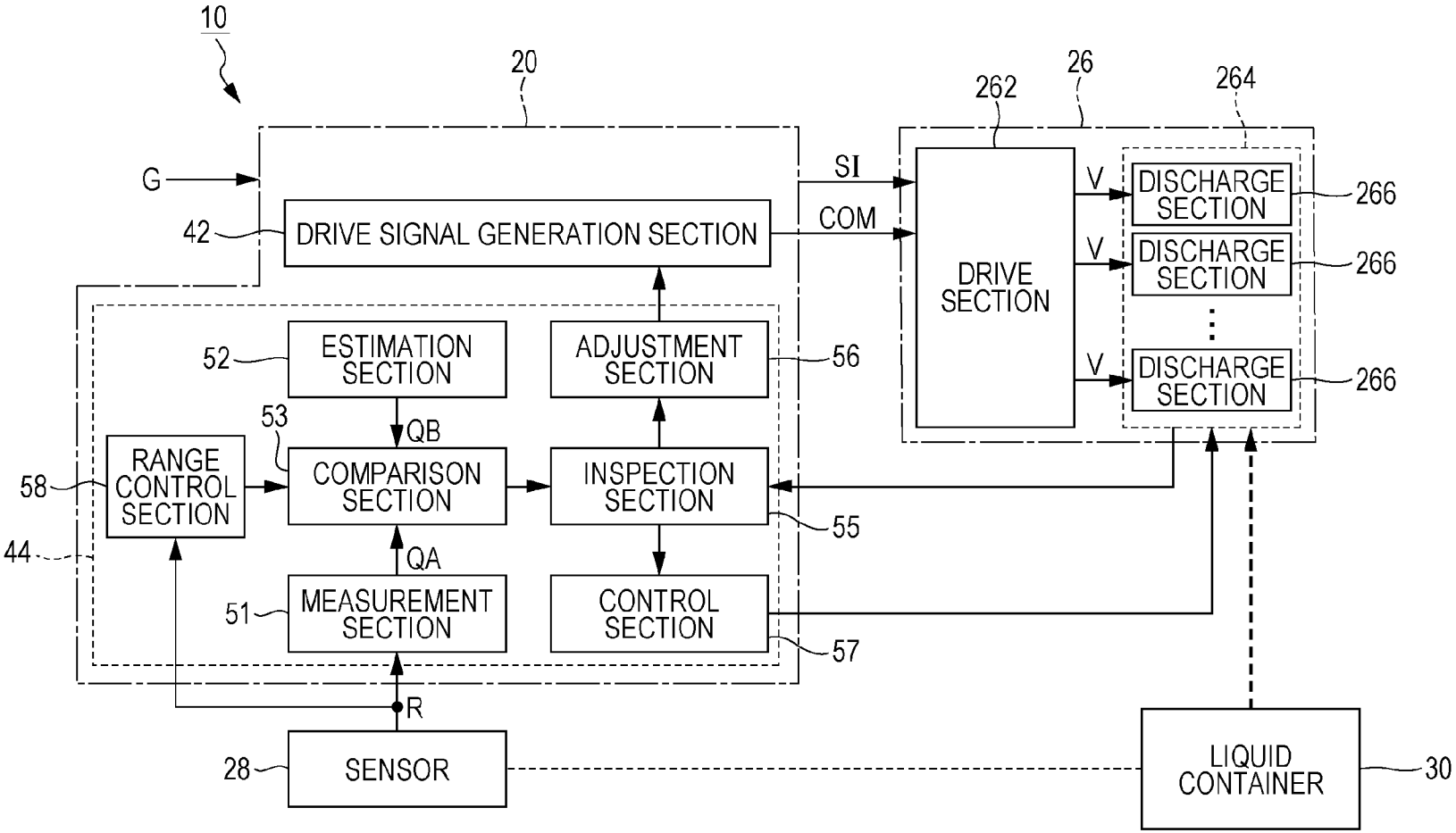
FIG. 9 is a functional configuration diagram of a liquid discharge apparatus according to a second embodiment.

FIG. 9 is a functional configuration diagram of a liquid discharge apparatus 10 according to the second embodiment. As is understood from FIG. 9, the liquid discharge apparatus 10 according to the second embodiment has a configuration in which a range control section 58 is added to the liquid discharge apparatus 10 according to the first embodiment. The range control section 58 variably sets the permissible range P (the upper limit value p1 and the lower limit value p2).

It is possible to replenish the liquid container 30 with low-viscosity or high-viscosity non-regular ink in addition to regular ink having a predetermined viscosity. Accordingly, at the stage when ink is added to the liquid container 30, the state of ink in the supply flow path (for example, viscosity) is unknown. Accordingly, at the stage immediately after the liquid container 30 is replenished with ink, it is desirable to actively adjust the amplitude A of the drive signal V so as to promptly bring the amplitude A close to a suitable amplitude A of the actual state of the liquid in the supply flow path. On the other hand, in the discharge management illustrated in FIG. 7, the narrower the permissible range P, the easier the determination result of step SA1 or step SA2 becomes negation. As a result, there is a tendency to easily adjust the amplitude A of the drive signal V. In consideration of the above circumstances, if ink is added to the liquid container 30, the range control section 58 according to the second embodiment reduces the permissible range P, and at the same time, expands the permissible range P with time.

Figure 10:
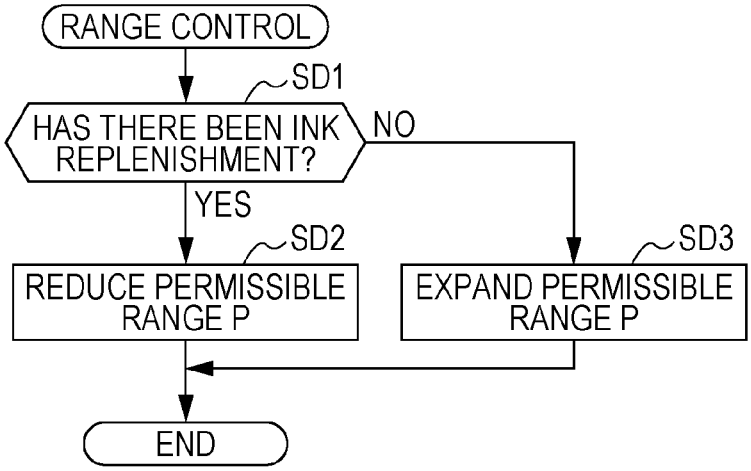
FIG. 10 is a flowchart of range control performed by a range control section according to the second embodiment.

FIG. 10 is an explanatory diagram of operation (hereinafter referred to as a "range control") of the range control section 58. For example, the range control in FIG. 10 is performed by the occurrence of an interruption at predetermined time intervals. When the range control is started, the range control section 58 determines whether or not the liquid container 30 has been replenished with ink (SD1). Specifically, whether or not the liquid container 30 has been replenished with ink is determined in accordance with the variation of the remaining quantity R of ink measured by the sensor 28. For example, the range control section 58 obtains the remaining quantity R from the sensor 28 each execution of the range control, and determines whether or not the liquid container 30 has been replenished with ink by comparing the remaining quantity R of the previous time with the remaining quantity R of this time. That is to say, if the latest remaining quantity R is larger than the remaining quantity R of the previous time, a determination is made that the liquid container 30 has been replenished with ink.

If determined that the liquid container 30 has been replenished with ink (SD1: YES), the range control section 58 reduces the permissible range P (SD2). Specifically, the range control section 58 decreases the error coefficient a1 and the error coefficient a2 by a predetermined value (zero or a positive number near zero). Accordingly, in step SA1 or step SA2 of the discharge management after that, the determination result tends to be negation, and the adjustment of the amplitude A of the drive signal V (SB1 and SC4) and the recovery operation (SC2) are frequently performed as a result. On the other hand, if determined that the liquid container 30 has not been replenished with ink (SD1: NO), the range control section 58 expands the permissible range P (5D3).

Specifically, the error coefficient a1 and the error coefficient a2 are increased by a predetermined variation. If the error coefficient a1 and the error coefficient a2 have reached a predetermined value, the error coefficient a1 and the error coefficient a2 are not increased. That is to say, if the liquid container 30 has been replenished with ink, the range control section 58 reduces the permissible range P, and expands the permissible range P to the predetermined range with time.

In the second embodiment, the same advantages as those of the first embodiment are achieved. Also, in the second embodiment, when the liquid container 30 is replenished with liquid, a permissible range P is reduced so that it becomes easy to perform the adjustment of the amplitude A of the drive signal V. Accordingly, regardless of the characteristic (the viscosity is high or low) of the ink refilled in the liquid container 30, it is possible to promptly adjust the drive signal V to have a suitable amplitude A capable of discharging ink having the characteristic at the target discharge characteristic.

Variation

It is possible to make various variations of each embodiment described above. Specific modes of variations are described as follows. It is also possible to suitably merge any two or more modes that are selected from the following examples within the range in which the modes do not contradict with each other.

(1) The element (drive element) that gives pressure inside the pressure chamber SC is not limited to the piezoelectric element 74 described in each of the above-described embodiments. For example, it is possible to use a heater element that generates bubbles inside the pressure chamber by heating to change pressure as a drive element. As is understood from the above example, the drive element is inclusively expressed as an element (typically an element that gives pressure inside the pressure chamber SC) for discharging liquid, and it does not matter which operation system (a piezoelectric system/a thermal system) is used or how a specific configuration is made.

(2) In the above-described embodiments, a serial head in which a carriage 24 including liquid discharge units 26 moves in the X-direction is described. However, it is possible to apply the invention to a line head in which a plurality of liquid discharge units 26 are disposed in the X-direction.

(3) It is possible to employ the printer described in each of the above embodiments for various devices, such as a facsimile machine, a copy machine, or the like in addition to a machine dedicated for printing. Moreover, the application of the liquid discharge apparatus of the invention is not limited to printing. For example, a liquid discharge apparatus that discharges color material solution is used for a manufacturing apparatus of a color filter of a liquid display device. Also, a liquid discharge apparatus that discharges conductive material solution is used as a manufacturing apparatus that forms wiring lines and electrodes of a wiring board.

The entire disclosure of Japanese Patent Application No. 2015-159132, filed Aug. 11, 2015 is expressly incorporated by reference herein.

What is claimed is:

1. A liquid discharge apparatus comprising:

a liquid discharge section configured to discharge liquid supplied from a liquid container in accordance with a drive signal;

a sensor configured to measure a remaining quantity of the liquid in the liquid container;

a measurement section configured to identify a measurement consumption quantity being a variation quantity of the remaining quantity in a measurement period;

an estimation section configured to estimate an estimated consumption quantity of the liquid in accordance with print contents in the measurement period;

a comparison section configured to make a comparison between the measurement consumption quantity and the estimated consumption quantity;

if the measurement consumption quantity is smaller than the estimated consumption quantity by comparison of the comparison section, an inspection section configured to inspect whether or not there is a discharge defect in the liquid discharge section; and if the inspection section determines that there are no discharge defects, an adjustment section configured to adjust an amplitude of the drive signal.

2. The liquid discharge apparatus according to claim 1, further comprising:

a control section configured to cause the liquid discharge section to perform a recovery operation if the inspection section determines that there is a discharge defect.

3. The liquid discharge apparatus according to claim 2, wherein the comparison section makes the comparison after the liquid discharge section discharges the liquid after the recovery operation is performed.

4. The liquid discharge apparatus according to claim 1, wherein if the measurement consumption quantity is within a permissible range including the estimated consumption quantity, adjustment by the adjustment section and inspection by the inspection section are not performed.

5. The liquid discharge apparatus according to claim 4, wherein if the measurement consumption quantity is larger than an upper limit value of the permissible range, the adjustment section decreases the amplitude of the drive signal.

6. The liquid discharge apparatus according to claim 4, wherein if the measurement consumption quantity is smaller than a lower limit value of the permissible range, the adjustment section increases the amplitude of the drive signal.

7. The liquid discharge apparatus according to claim 4, wherein the liquid container has a configuration to allow addition of the liquid, and the liquid discharge apparatus further includes a range control section configured to determine whether or not the liquid is added to the liquid container in accordance with a variation in the remaining quantity of the liquid measured by the sensor, and if determined that the liquid is added, to reduce the permissible range and then to expand the permissible range with time.

* * * * *